United States Patent [19]

Nanjyo et al.

[11] 4,021,603

[45] May 3, 1977

[54] ROOF FOR ARC FURNACE

[75] Inventors: Toshio Nanjyo; Masayuki Aoshika, both of Yokohama, Japan

[73] Assignee: Ishikawajima-Harima Jukogyo Kabushiki Kaisha, Tokyo, Japan

[22] Filed: Oct. 22, 1975

[21] Appl. No.: 624,766

[52] U.S. Cl. ..... 13/35

[51] Int. Cl.[2] ..... F27D 1/12

[58] Field of Search ..... 13/35, 32; 432/62

[56] References Cited

UNITED STATES PATENTS

| | | | |
|---|---|---|---|
| 3,756,172 | 9/1973 | Brereton et al. | 13/35 X |
| 3,829,595 | 8/1974 | Nanjyo et al. | 13/35 |

*Primary Examiner*—R. N. Envall, Jr.

*Attorney, Agent, or Firm*—Scrivener, Parker, Scrivener & Clarke

[57] ABSTRACT

A roof assembly for an arc furnace is disclosed in which a furnace roof ring and a plurality of roof units are assembled together to define a roof section frustoconical in cross section and with a roof top opening, and a roof top made of an electrically insulating refractory and provided with electrode holes closely fitted into the roof top opening. Each sectionalized roof unit comprises a main body cast from cast iron or copper, and a cooling coil embedded in the main body with end sections being extended out of the upper major upper surface of the main body so as to be used as a cooling water inlet and an outlet. In order to ensure the satisfactory high-temperature strength and thermal-shock resistance, the inner major surface of the main body directed toward the inside of the furnace is partially lined with the refractory or corrugated.

2 Claims, 5 Drawing Figures

ROOF FOR ARC FURNACE

DETAILED DESCRIPTION OF THE INVENTION

The present invention relates to a roof assembly for an arc furnace. Since the temperature inside the arc furnace is higher than 1,600° C, the prior art furnace roof consists of fire bricks laid in the form of a dome. However, the erosion of the fire bricks has recently become very quick because the capacity of the arc furnace is increased; the capacity of the transformer used is increased, thus resulting in the furnace operation at higher power; auxiliary burners are used; a dust collector system is employed for directly sucking the furnace gases through the furnace roof; and the continuous charging of reducing pellets is employed, resulting in the exposure of the furnace roof to high temperature heat for an increased time. As a result, the life of the furnace roof becomes very short, thus resulting in the increases in cost as well as idle time required for the repair or replacement of the furnace roof.

In order to reduce the operating cost and to attain the continuous furnace operation, it is imperative to provide a furnace roof whose service life is sufficiently long.

In view of the above, the primary object of the present invention is to provide a roof assembly for an arc furnace having a semi-permanent service life.

It is almost impossible at present to increase the life of the furnace roof only by the improvement of the heat-resisting properties of the refractory materials. To overcome this problem, there has been devised and demonstrated a furnace roof which is made of steel and which is provided with water jackets, but the above furnace roof has the following defects:

i. Since the water jackets are formed by welding steel plates, water leakage very often tends to occur through the welded joints.

ii. When the thickness of the steel plates used is excessive, cracking of the water jacket occurs because of the temperature difference between the surface exposed to the cooling water and the surface exposed to the high temperature in the furnace. Therefore, relatively thin steel plates must be used, but when the water jacket made of thin steel plates is exposed to the sparks which are frequently produced by the contact of charged metal scrap with the elctrodes in the initial stage of the melting process, holes are formed through the walls of the water jacket so that the cooling water leaks.

iii. Since the water jackets are made of thin steel plates, a large quantity of cooling water is required, resulting in the increase in heat absorption and consequently reducing the thermal efficiency of the furnace. Furthermore, the life of the water-jacket furnace roof is reduced.

To overcome these defects, there has been also devised and demonstrated a method for cooling the fire-brick furnace roof by circulating cooling water through cooling coils or tubes placed within the fire bricks. According to this method, the grooves or the like must be formed in the fire bricks in order to receive the cooling coils or tubes so that the cost becomes very expensive. Furthermore, this method cannot provide a sufficiently large cooling area so that the cooling efficiency is low.

As described above, the prior art furnace roofs made of materials other than fire bricks have not satisfactorily solved the problem of water leakage and hence the problem of a long service life.

The present invention was therefore made to provide a water-cooled furnace roof assembly which may completely eliminate the problem of water leakage. Briefly stated,the present invention provides a roof assembly for an arc furnace comprising a furnace ring made of metal and defining the outer periphery of the roof assembly, and a plurality of sectionalized roof units assembled together within said roof ring, each sectionalized roof unit comprising a main body cast from cast iron or copper and a cooling coil embedded in said main body in such a way that cooling water may be charged into and discharged from said cooling coil, the inner major surface of said main body directed toward the inside of the furnace having a high-temperature and thermal-shock resistance construction.

The present invention will become more apparent from the following description of some preferred embodiments thereof taken in conjunction with the accompanying drawings, in which.

Same reference numerals are used to designate similar parts throughout the figures.

Figure 1:
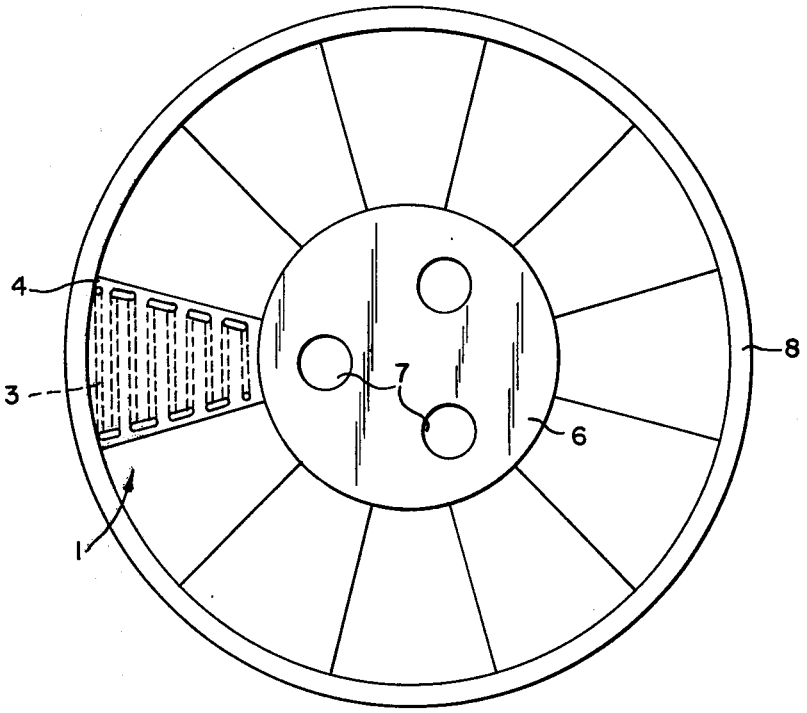
FIG. 1 is a schematic top view of a first embodiment of the present invention.
Figure 2:
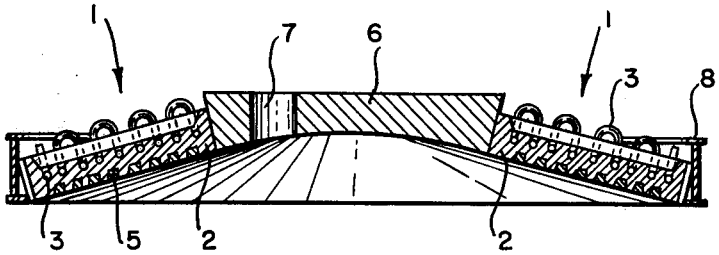
FIG. 2 is a cross sectional view thereof.
Figure 3:
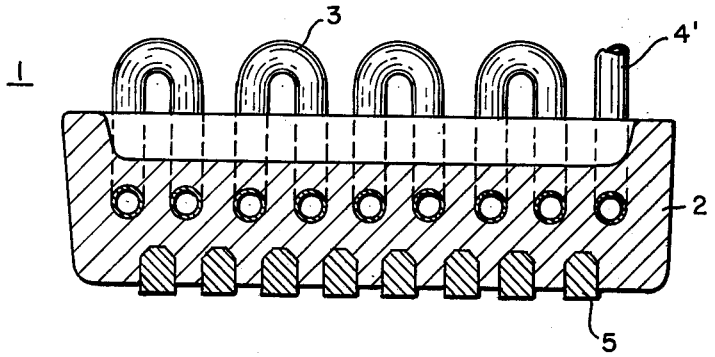
FIG. 3 is a cross sectional view of a sectionalized roof unit thereof.

FIRST EMBODIMENT, FIGS. 1, 2 and 3

Referring to FIGS. 1, 2 and 3, there is shown a first embodiment of a furnace roof in accordance with the present invention comprising a circular roof top 6 and a plurality (12 in the instant embodiment) of equiangulary radially sectionalized roof units 1 and a roof ring 8.

The sectionalized units 1 are similar in construction so that only one of them will be described in detail. The unit 1 comprises a main body 2 cast from cast iron or copper and a hairpin type cooling coil 3 which has been embedded in the main body 2 when the latter was cast. The paralleled adjacent sections of the cooling coil 3 are spaced apart by a suitable distance, and the ends 4 and 4'0 , which serves as an inlet and an outlet, respectively, of cooling water as well as the 180° return bend sections of the cooling coil 3 are extended out of the upper major surface of the main body 2 as best shown in FIG. 2. A plurality of fire bricks 5 are partially embedded in the lower or inner surface of the main body 2 as best shown in FIG. 3. The trapezoidal-shape sectionalized furnace roof units 1 with the above construction are assembled with the roof top 6 and the roof ring 8 as shown in FIGS. 1 and 2.

That is, the arcuate longer base sides of the units 1 are positioned along the inner wall of the roof ring 8 which is made of metal and defines the outer periphery of the furnace roof assembly, and the side walls of the roof units 1 are abutted against each other so that the roof units 1 are assembled and securely held in position by their own weights in the form of a truncated cone as best shown in FIG. 2. Thus, the semi-permanent substructure of the furnace roof assembly is provided, and the inner arcuated shorter bases of the roof units 1 define a circular top opening having the inverted frustoconical cross sectional configuration as best shown in FIG. 2. The roof top 6, which is made of electrically insulating refractory materials, is a consumable substructure and has three electrode holes 7, closely fitted into the top opening. Thus, the furnace roof assembly is completely assembled.

In the instant embodiment, in order to minimize the weight of the furnace roof assembly, the sectionalized roof units 1 are abutted against each other, but any suitable means may be used for securely holding them together.

SECOND EMBODIMENT, FIG. 4

Figure 4:
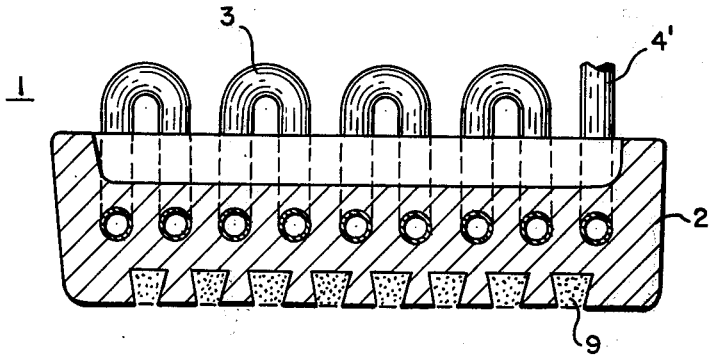
FIGS. 4 and 5 are cross sectional views of sectionalized roof units of a second and a third embodiments, respectively.

The second embodiment shown in FIG. 4 is substantially similar in construction to the first embodiment except that instead of the fire bricks 5, amorphous refractory material 9 such as magnesia, high alumina or the like is stamped into the grooves formed in the lower or inner surface of the sectionalized roof unit 1 in order to improve the resistance to heat of the furnace roof assembly.

THIRD EMBODIMENT, FIG. 5

Figure 5:
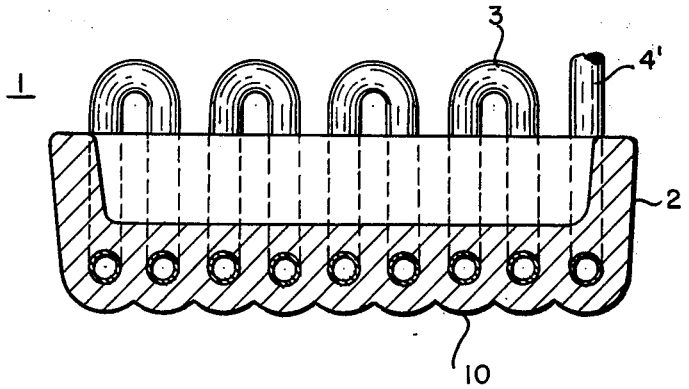

The third embodiment shown in FIG. 5 is also substantially similar in construction to the first embodiment except that no refractory material such as fire brick 5 or amorphous refractory material 9 is used and that the inner surface of the roof unit 1 is corrugated as shown at 10. The arcuate convex portion of the corrugated inner surface 10 is coaxial with the corresponding cooling tube or coil section 3, and the spacing or distance between the arcuate convex portion and the cooling tube section is so selected that the temperature of the inner surface of the furnace roof assembly may be maintained at a temperature lower than the melting point of the roof unit 1, but higher than the solidifying point of molten charge in the furnace.

As a variation of the third embodiment, amorphous refractory materials may be stampped into the corrugated inner surface of the roof unit 1.

In operation, cooling water is charged into the inlet 4 of the cooling coil 3, flows therethrough and is discharged out of the outlet 4'0 so that not only the main body 2 but also the roof top 6 may be sufficiently cooled. Since the inner surface of the roof unit 1 is provided with the fire bricks 5 (See FIG. 3) or amorphous refractory material 9(See FIG. 4) or is corrugated as shown at 10(See FIG. 5), there is no fear of craking of the cooling coil 3 of the roof unit 1 due to the thermal stresses produced by the temperature difference between the cooling water flowing through the cooling coil 3 and the cooling coil 3. Even if the cooling coil 3 should be cracked, there is no fear at all of water leakage because the cooling coil 3 is embedded in the main body 2. Therefore, the long life of the furnace roof assembly may be ensured, and there is no fear that the water leakage will induce the explosion of the furnace even when the sparks are produced by the short-circuits between the electrodes and the scrap in the initial stage of the melting process.

The different types of the sectionalized roof units 1 may be selected depending upon the thermal conditions within the furnace and other operating conditions. For instance, the roof units 1 of the first embodiment may be used when the thermal conditions of the furnace are severe, but when the thermal conditions are not so severe, the roof units 1 of the type shown in FIG. 4 may be used. When the thermal conditions are too severe so that the life of refractory used is expected to be very short, the roof units 1 of the type shown in FIG. 5 may be used. However, in the furnace operation the splashes of the molten charge tend to adhere to the inner surface of the furnace roof assembly and are solidified to form a sort of protective layer so that the quantity of heat dissipated through the furnace roof assembly may be reduced. Consequently, the longer service life of the roof assembly may be ensured, and the thermal efficiency is very high in furnace operation.

So far only the exemplary embodiments of the present invention have been described, but it will be understood that the present invention is not limited thereto and that various modifications may be effected within the true spirit of the present invention.

The features and advantages of the furnace roof assemblies in accordance with the present invention may be summarized as follows:

I. Since the cooling coil is cladded or embedded in the main body, there is no fear of the water leakage even if the cracks should be started in the main body due to the thermal fatigue thereof.

II. Since the main body of the roof unit has a large thermal capacity, and the cooling water flows through the cooling coil embedded in the main body, there is no fear that the water leakage induces the explosion of the arc furnace even when sparks are produced.

III. The heat resisting ability of the sectionalized roof units is much improved because the fire bricks are partially embedded, the amorphous refractory is stamped into the inner surface of the unit or the inner surface is corrugated so that the adhesion to the inner surface of the splashes is much facilitated, resulting in the easy formation of a protective layer. As a result, the heat loss may be minimized, and the service life may be increased. The distinctive features of the corrugated inner surface are that the cracking of the sectionalized roof units due to the thermal stresses caused by the temperature difference may be substantially eliminated and that the cost is low.

IV. Because of the above features (I), (II) and (III), the roof assembly in accordance with the present invention has a semi-permanent service life.

V. The spare roof tops may be provided so that the repair of the furnace roof assembly may be accomplished simply by replacing the furnace roof top. Since the life of the furnace roof assembly except the roof top is semi-permanent, it is not necessary at all to keep in hand the spare furnace roof assembly.

VI. Since the sectionalized roof units are not suspended, there is no additional weight. Therefore, the furnace roof assembly in accordance with the present invention has the weight substantially similar to that of the prior art furnace roof made of fire bricks so that the modifications of the existing arc furnaces and of the furnace operations are not necessary.

VII. Since the life of the roof assembly is semi-permanent and the idle time for replacing the roof top is short, the furnace operation efficiency may be remarkably increased, thus resulting in the reduction in operating cost.

What is claimed is:

1. A roof assembly for an arc furnace comprising a roof ring made of metal and defining the outer periphery of the furnace roof assembly, and a plurality of unitary, sectionalized roof units asssembled together in said roof ring to define the furnace roof, each unit comprising a trapezoidal-shaped, cast metallic member having spaced-apart inner and outer arcuate surfaces, a cooling coil embedded in said member for receiving and discharging a cooling liquid, and the units being arranged with their sides in abutting relationship and with the outer arcuate surfaces engaging said roof ring, said units being in the form of a truncated cone and being self-supporting.

2. A roof assembly as set forth in claim 1 wherein the inner arcuate surfaces of the abutting roof units are shaped to define a substantially inverted truncated conical seat, and a roof top fitting into said seat.

* * * * *